US005505258A

United States Patent [19]

Muth

[11] Patent Number: 5,505,258

[45] Date of Patent: Apr. 9, 1996

[54] PARALLEL TUBING SYSTEM FOR PUMPING WELL FLUIDS

[75] Inventor: Garold M. Muth, Bakersfield, Calif.

[73] Assignee: Muth Pump LLC, Bakersfield, Calif.

[21] Appl. No.: 325,971

[22] Filed: Oct. 20, 1994

[51] Int. Cl.[6] ..... E21B 43/12

[52] U.S. Cl. ..... 166/72; 166/117; 166/313

[58] Field of Search ..... 166/72, 313, 369, 166/117

[56] References Cited

U.S. PATENT DOCUMENTS

| | | | |
|---|---|---|---|
| 2,797,642 | 7/1957 | Bloudoff . | |
| 3,167,019 | 1/1965 | Harris . | |
| 3,765,483 | 10/1973 | Vencil | 166/313 X |
| 3,771,603 | 11/1973 | Crowe | 166/72 X |
| 3,802,802 | 4/1974 | Greer | 417/98 |
| 4,056,335 | 11/1977 | Secrist | 417/431 |
| 4,646,839 | 3/1987 | Rickey | 166/313 X |

*Primary Examiner*—Terry Lee Melius
*Attorney, Agent, or Firm*—Townsend and Townsend and Crew

[57] ABSTRACT

The present invention provides a pumping system having separate parallel power tubing and production tubing strings in which production is pumped up the production tubing through a removable flow control valve and a rod operated insertable and removable pump is disconnectably connected into the power tubing wherein the insert type pump and the removable flow control means may be removed from and inserted into, respectively, the power tubing and the production tubing strings without the need to remove either tubing string from the well.

8 Claims, 4 Drawing Sheets

PARALLEL TUBING SYSTEM FOR PUMPING WELL FLUIDS

BACKGROUND OF THE INVENTION

1. Field of the Invention

The present invention is directed to a pumping system for producing well fluids from petroleum producing formations penetrated by a well and specifically the present invention includes the use of dual parallel tubing strings having the lower portions connected by a cross-over flow connection, one of the tubing strings forming a flow path for flowing production fluids to the surface and the other for providing a conduit for inserting, operating and removing an insert type pump used to lift well fluids from the well and to move the well fluids up the well to the surface through the cross-over flow connection and a flow control valve in the production flow path.

2. Description of Related Art

Pumping well fluids from wells penetrating producing formations has been done for many years. This is particularly true where heavy viscous oil must be moved to the surface. Often heavy viscous oils such as produced from California formations which are relatively close to the earth's surface contain sand and are difficult to pump. Steam and diluents have often been used to lower the viscosity of heavy crudes to improve flow and pumping efficiency; however, sand is still a major problem.

Heretofore dual tubing strings for a pumping system for producing petroleum have been suggested. For example, pumping installations utilizing parallel dual tubing strings are disclosed in U.S. Pat. Nos. 4,056,335 to Walter S. Secrest; U.S. Pat. No. 3,802,802 to F. Conrad Greer; and U.S. Pat. No. 3,167,019 to J. W. Harris.

There is still need, however, for a pumping system having dual production and power tubing strings which permit ease of operation and in which all of the movable parts of the pumping and flow control apparatus may be both removed from the tubing strings and replaced in the tubing strings without the need for removing the tubing strings from the well.

BRIEF SUMMARY OF THE INVENTION

The present invention provides apparatus for producing well fluids from an oil bearing formation penetrated by a well including production tubing means forming a production flow path for production fluids between the earth's surface and a location in the well suitable for receiving well production fluids from a pump located in a parallel power tubing means. Flow control means are located in the lower portion of the production tubing means to permit flow of production fluids up the production flow path and to prevent flow of production fluids down the production flow path. Power tubing means are extended down the well in parallel relationship with the production tubing means to a location in the well suitable for receiving production fluids into the lower portion of the power tubing means from said well. An insert type pump is provided and is adapted to be inserted and removed from the power tubing means while the power tubing means are located in the well. Means are provided for disconnectably connecting the insert type pump in the power tubing means adjacent the lower portion thereof in a position for pumping well fluids from the well into the lower portion of the power tubing means. A cross-over flow path is formed between the lower portion of the power tubing means and the flow path of the production tubing means below the flow control means for flowing production fluids out of the power tubing means and into the flow path of the production tubing means as the only flow path for transfer of production fluids to the earth's surface. Means for operating the insert type pump are operatively connected to the pump. Preferably the means for operating the pump includes a pumping rod string extending down the power tubing means and operably connected to the insert type pump through the power tubing means. The operative elements of the insert type pump are preferably located in the well below the location of the flow control means. Both the insert pump and the moving portion of the flow control means are insertable and removable from the tubing means without the need of pulling the tubing from the well.

In a more specific aspect the present invention provides apparatus for pumping petroleum from a well penetrating a petroleum producing formation which includes a downhole assembly located in a well at a position adapted to receive petroleum fluids from the well. The downhole assembly includes a parallel anchor having a first passage and a second passage formed parallel to the central axis of the parallel anchor. Means are provided for mounting the parallel anchor in the well at the desired position and a tubular connecting pup is connected to the first passage of the parallel anchor and extends down the well. A flow control means such as a standing valve which permits flow up the connecting pup tubing and prevents flow down the connecting pup tubing is connected in the lower portion of the connecting pup. A tubular gas anchor is positioned in the well below the parallel anchor and is connected by means of a tubular landing nipple and the power tubing string with the second passage of the parallel anchor. A cross-over flow head is connected between the lower end of the connecting pup tubing below the standing valve and an opening in the tubular gas anchor to provide a flow path for petroleum from the gas anchor through the standing valve into the lower portion of the connecting pup tubing. A production tubing string extends from the earth's surface down the well and is inserted into the first passage of the parallel anchor to form, in combination with the cross-over flow head, the connecting pup tubing and a tubular string, a flow path to the earth's surface for petroleum. A power tubing string is positioned in the well parallel to the production tubing string and extends through the second passage in the parallel anchor. Connecting means connect the lower end of the power tubing string to the upper end of the tubular landing nipple. An insert type pump is inserted into the power tubing and landed in the tubular landing nipple. Means are provided to form a flow path for petroleum between the lower portion of the power tubing string and the lower portion of the production tubing string. Means are provided for disconnectably connecting the insert type pump in operating position in the power tubing and the landing nipple for pumping fluid up the power tubing string to the flow path of the production tubing string. Means for operating the insert type pump are operatively connected to the pump.

The present invention provides an assembly which includes parallel power tubing and production tubing strings. An insert pump is located inside and at the bottom of the power tubing string. The power tubing string connects to a bottom hole assembly with a crossover flow head which connects with the production tubing string. This provides for flow of production fluids from the pump to the production tubing string. A rod string, connected to a pumping unit at the surface gives the insert type pump an up-and-down motion for pumping the well fluid to the surface through this production tubing string. Diluent or water with a surfactant may be placed in the power tubing string for lubrication between the rod string and the power tubing string.

The present invention utilized a rod insert pump. Thus the insert type down hole pump is connected to the rod string and is inserted inside the power tubing string. Only the rod string has to be pulled to retrieve all moving and wearable pump parts. Thus the apparatus of the present invention will save rig time when pump repairs or replacement is needed. Also because the production flow path is separated from the pumping rod string the apparatus of the present invention will never have a floating rod problem. It will also eliminate inertia bars and require smaller less expensive rods.

The present invention provides advantages from a servicing and repair point of view. In a conventional system when a pump is retrieved from the well, usually the tubing string and sucker rods must be pulled "wet", that is without draining the tubing, which not only is an awkward operation, but causes objectionable oil spills on the ground above the well. This is generally caused by the pump being sanded up or stuck in the pipe because of sand settling out of the production on top of the pump whenever the well is idle for short periods of time. The apparatus of the present invention will never have to be pulled "wet" regardless of how much sand the well is producing because, the production tubing string and the power tubing string can be drained if it becomes necessary to pull the bottom hole assembly from the well.

OBJECT OF THE INVENTION

A principal object of the present invention is to provide a pumping system having separate parallel power tubing and production tubing strings in which production is flowed up the production tubing through a removable flow control valve connected to the lower end of the production tubing. A rod operated insertable and removable pump is disconnectably connected into the power tubing wherein the insert type pump and the removable flow control means may be removed from and inserted into, respectively, the power tubing and the production tubing without the need to remove either tubing string from the well. Additional objects and advantages of the present invention will become apparent to those skilled in the art from the drawings which are made a part of this specification and the detailed description of the invention.

DETAILED DESCRIPTION OF THE INVENTION

Figure 1:
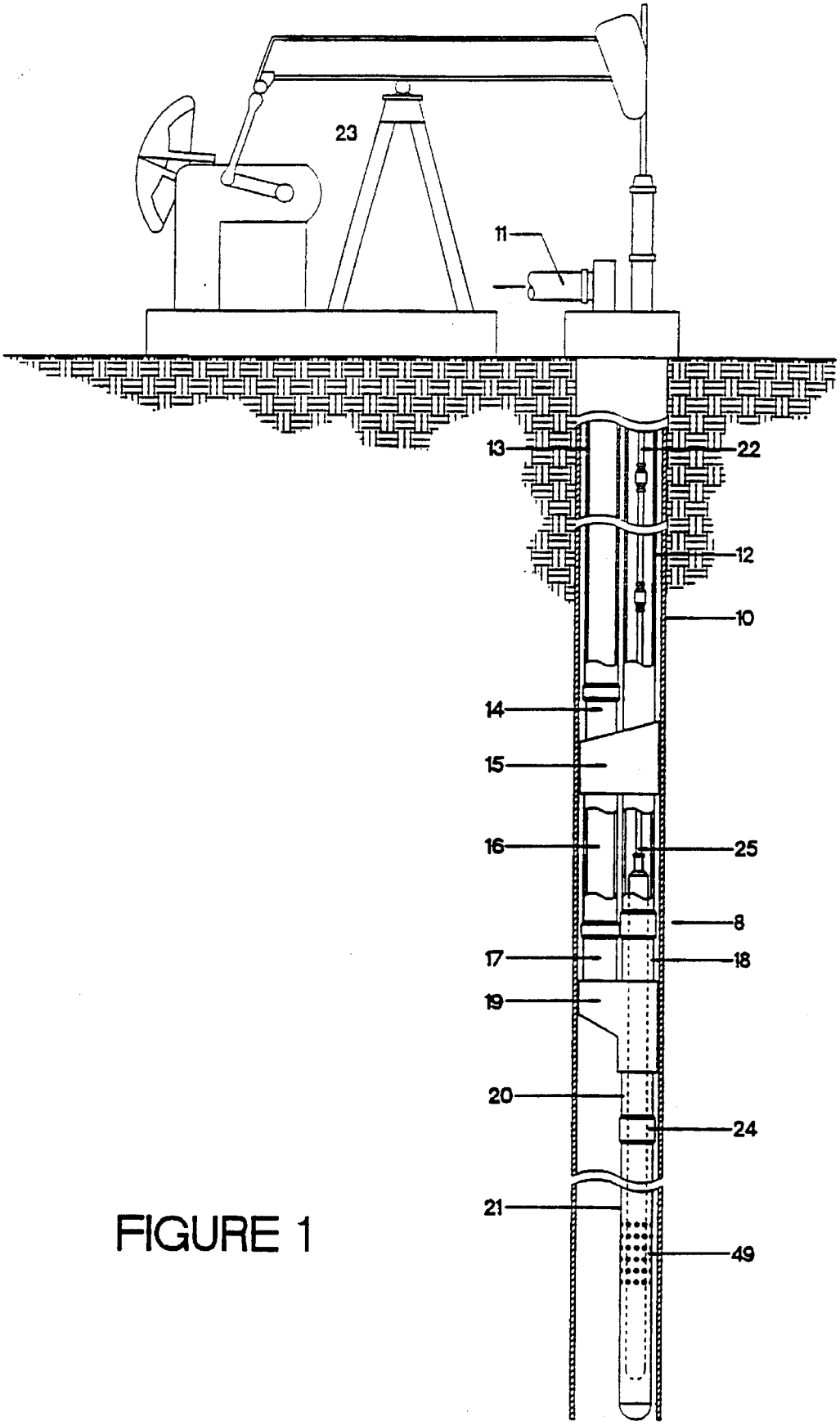
FIG. 1 is a diagrammatic vertical sectional view of a well equipped with a pumping system assembled in accordance with the patent invention.
Figure 2:
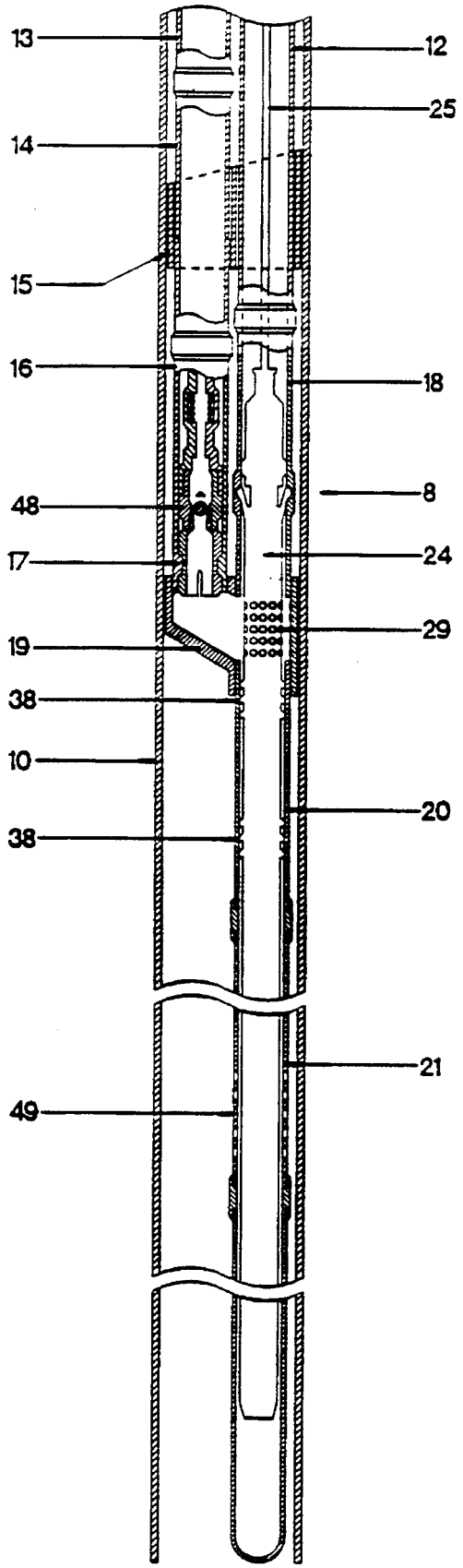
FIG. 2 is an enlarged vertical sectional view of the lower portion of the well and shows a bottom hole assembly which includes a rod insert bottom hole pump and a cross-over flow connector assembled in accordance with the present invention.

FIG. 1 shows an overall sectional view of a pumping assembly in accordance with the present invention. A casing 10 is operably positioned in the well. Parallel power tubing 12 and production tubing 13 strings are positioned in the casing and connect with the bottom hole assembly indicated generally by the numeral 8 which houses a down hole rod insert pump 24. The power tubing 12 and the production tubing 13 provide paths between the surface and a position in a well where well fluids are produced. As shown in FIGS. 1 and 2 a parallel anchor 15, having a first passage on the left and a second passage on the right of the anchor. A stab in tubing member 14 forming the bottom of the tubing string 13 extends through the first passage and is attached to the top of a connecting pup tubing 16 that screws into the top of a standing valve nipple 17. A cross-over flow head 19 attaches to the bottom of the standing valve nipple 17 on the left side. The right side of the cross-over flow head 19 is attached to the bottom of a lock shoe landing nipple 18 and the top of sealing nipple 20. The power tubing string 12 passes down through the second passage in parallel anchor 15 on the right side and screws into the top of the lock shoe landing nipple 18. Beneath the cross-over flow head 19 is a sealing nipple 20 which screws into the top of a gas anchor 21. When the production tubing string 13 is installed, the power tubing string 12 and the bottom hole assembly are already made up together and in place down hole in the well at a suitable location for recovering well fluids.

Figures 3, 3A, 3B:
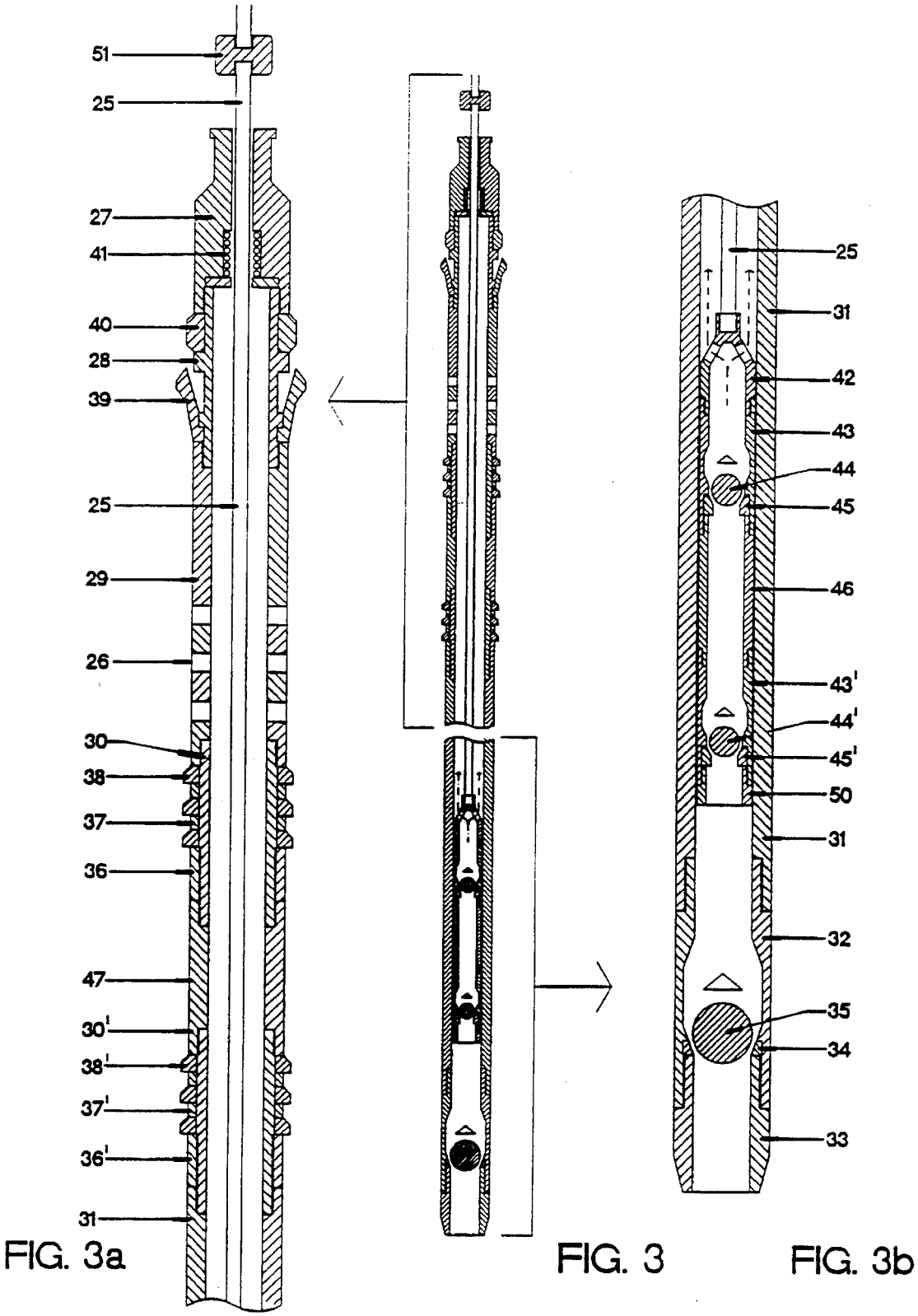
FIG. 3 is a vertical sectional view of the rod insert pump that is disconnectably connectable inside the bottom hole assembly of FIG. 2.
FIG. 3*a* is an enlarged sectional view of the upper portion of the pump of FIG. 3 as indicated by the arrow in FIG. 3.
FIG. 3*b* is an enlarged sectional view of the lower portion of the pump of FIG. 3 as indicated by the arrow in FIG. 3.

The production tubing string 13 has attached to the bottom of it a stinger 14 with seals which then stabs into the passage provided in the left side of the parallel anchor 15. At the surface the production string 13 is connected to a flow line 11 which carries well fluids off to a production tank. An insert type pump 24 is adapted to be inserted and removed from the power tubing. The insert pump 24 has a polished pull rod 25 that is connected to a rod string 22. The rod string 22 protrudes upward through the inside of the power tubing string 12 to the surface and is then hung off the bridle and horses head of a pumping unit 23. The pumping unit gives the down hole rod insert pump 24 its up and down motion to pump the well fluids to the surface. The down hole rod insert pump 24 is also sealed inside of the top lock shoe landing nipple 18 which holds the body or outside of the rod insert pump 24 in place and allows only the plunger formed of parts 42–46 and 43'–45' as shown in FIGS. 3, 3*a* and 3*b*, to reciprocate up and down to pump the well fluids. The nipple 17 is formed from the bottom portion of a tubing liner pump barrel that seats the standing valve 48 to provide a flow control means in the production tubing flow path. The standing valve 48 may be removed from its seal in the nipple 17 without removing the production tubing from the well using the rod string 22 and a conventional off-on tool.

Referring again to FIG. 2 which shows the bottom hole assembly in more detail, the parallel anchor 15, with a stab in tubing member 14 having a sealing port for stabbing in, is attached to the top of the connecting pup 16 that screws into the top of the standing valve nipple 17. The cross-over flow head 19 attaches to the bottom of the standing valve nipple 17 on the left side. The right side of the cross-over flow head 19 is attached to the top lock shoe landing nipple 18 and the sealing nipple 20. The power tubing string 12 then passes down through the parallel anchor 15 on the right side and screws into the top of the top lock shoe landing nipple 18. Beneath the cross-over flow head 19 is a sealing nipple 20 which screws into the top of the gas anchor 21. When the production tubing string 13 is installed, the power tubing string 12 and the bottom hole assembly are already made up together and in place down hole. The production tubing string 13 has attached to the bottom of it a stinger 14 with seals which then stabs into the left side of the parallel anchor 15. The nipple 17 is the bottom portion of a tubing liner pump barrel that seats a removable standing valve 48.

Retrieving the bottom hole assembly from the well should never be necessary unless a hole develops in the power tubing string 12 from wear by the action of the rod string. If this should happen, while the rod insert pump 24 is at the surface, simply pull the production tubing string 13, unsealing the stinger 14 with seals out of the parallel anchor 15. After this apparatus is at the surface, the bottom hole assembly may be pulled out with the power tubing string 12.

FIGS. 3, 3*a* and 3*b* show a more detailed view of the bottom hole rod insert pump 24. The top of the rod insert pump 24 has a housing guide 27 that houses either "O" rings or chevron packing 41 that seals off around the polished pull rod 25 and prevents the well fluids from traveling up into the power tubing string 12. The housing guide 27 is attached to the upper end of the top lock assembly mandrel 28 which holds in place the seating ring 40 and the top lock hold down spring 39. The top lock seating ring 40 seats inside the landing nipple 18 as shown in FIGS. 1 & 2. This provides a seal off between the well fluids in the cross-over flow head 19 and the diluent in the power tubing string 12.

The top lock hold down spring 39 locks inside the landing nipple 18 as shown in FIG. 2 and provides a mechanical lock to hold down the rod insert pump 24 to thus disconnectedly connect the pump in the lower portion of the power tubing assembly. Below the top lock assembly mandrel 28 is a production diverting nipple 29 with side ports 26 to divert well fluids from inside the rod insert pump 24 to the cross-over flow head 19, through the removable standing valve 48 in the production flow path and up into the production tubing string 13. The first seal off assembly mandrel 30 mounts below the production diverting nipple 29 and holds in place the sealing cups or "O" rings 38, ring spacers 37 and lock nut 36. The sealing cups or "O" rings 38 seal off between the inside dimension of the sealing nipple 20 and the outside dimension of the rod insert pump body 24 as shown in FIG. 2. This seal-off prevents the well fluids that have just passed upward through the rod insert pump 24 from returning back down the outside of the rod insert pump 24 into the well bore. The lock nut 36 screws on the bottom of the seal-off assembly mandrel 30 to hold the cups or "O" rings 38 and ring spacers 37 in place. A spacing nipple 47 separates the second seal off assembly mandrel from the first seal off assembly mandrel 30. All features of the second seal off assembly mandrel 30 are identical to the first seal off assembly mandrel 30 and provide the same function and are indicated by a prime on the number in the drawings. Below the second seal off assembly mandrel is the pump barrel 31 that the plunger including parts 42–46 and 43'–45' travels up and down within. Below this pump barrel 31 is the standing valve assembly 32. Within the standing valve assembly 32 is a ball 35, seat 34 and a pump shoe 33. Protruding upward from the plunger and through the housing guide 27 into the power tubing string 12 connecting to the rod guide bushing 51 is the polished pull rod 25. This polished pull rod 25 is screwed into the first segment of the plunger and is called the plunger cage 42. The plunger cage 42 is designed with openings at the top for well fluids to move from inside the plunger to above the plunger. The plunger includes two traveling valves cages 43, 43' one at the top and bottom of the plunger barrel 46. Both top and bottom traveling valve cages 43, 43' have a ball 44, 44' and a seat 45, 45' within. The top traveling valve seat 45 is held in place by the plunger barrel 46 and the bottom seat 45' is held by a seat plug 50. The plunger cage 42 on top of the traveling valves 44, 44' screws onto the bottom of the polished pull rod 25.

When the bottom hole assembly and rod insert pump are installed in a well, the bottom hole assembly must be made up first and run into the casing 10 on the power tubing string 12 and placed at the bottom of the hole. Next, the production tubing string 13 is run into the well with the stinger and seals 14 on the bottom and stabbed into the parallel anchor 15 already in place at the bottom of the hole. The retrievable standing valve 48 will be run into the production tubing string 13 on the bottom of the rods 22 with an on-off tool and seated inside the standing valve nipple 17. The standing valve 48 is released from the on-off tool and the standing valve 48 is seated in the standing valve nipple 17. The rods 22 are pulled from the hole. The production tubing string 13 is filled with fluid (water, diluent or etc.) and the standing valve 48 will allow the tubing 13 to fill. The rod insert pump 24 can now be assembled and run on the bottom of the rod string 22 into the bottom hole assembly through the power tubing string 12. The rod insert pump 24 is halted one rod joint high from seating the rod insert pump in the landing nipple 18 of the bottom hole assembly. Diluent, light crude or water solution is pumped down the power tubing string 12, around the rod insert pump 24 and out into the formation just enough to clear the power tubing string 12 of any heavy crude. The rod insert pump 24 is seated in the landing nipple 18, the rods 22 are spaced out and hung onto the pumping unit 23. Finish filling the power tubing string 12 with diluent or surfactant and start the pumping unit 23 to operate the pump.

In operation, the pumping unit 23 alternately raises and lowers the sucker rods, polished pull rod 25, and plunger through upstrokes and downstrokes in the usual fashion. On each upstroke well fluid is drawn into the pump barrel 31 through the perforations 49 in the gas anchor 21 and through the standing valve assembly 32 in the bottom of the rod insert pump 24 to a position under the pump plunger. All this time, the well fluid above the plunger is being forced upward out of the pump barrel 31 into the cross-over flow head 19 through the retrievable standing valve 48 and into the production tubing string 13. On the downstroke of the plunger, both the retrievable standing valve 48 above the rod insert pump 24 and the standing valve 32 at the bottom of the rod insert pump 24 close. As the plunger continues its downward motion both traveling valves 43, 43' in the plunger are forced open by the pressure that is being created in the pump barrel 31 under the plunger and above the pumps standing valve 35. The well fluid passes through both traveling valves 43, 43' until the plunger reaches the bottom of its stroke, at which time both traveling valves will close. Then the process starts all over again with the next upstroke. Because the production tubing string 13 is filled, fluid will be pumped out of the production tubing string 13 on the first stroke or two of the pumping unit 23.

Retrieving the rod insert pump 24 for repairs is very simple because all moving and wearable parts except for standing value 48 come out of the bottom hole assembly when the rods 22 are pulled. When the rod insert pump 24 is pulled, the production tubing string 13 should remain full because of the standing valve 48. More than likely, the standing valve 48 will not need changing. To check if replacement is required, simply place a wet rag over the production tubing string 13 to see if it has a suck. If so, this indicates that fluid is leaking past or through the standing valve 48 and it should be changed out. Simply run the rods 22 with the on-off tool into the production tubing string 13, latching on to the standing valve 48, unseating and pulling the standing valve 48 to the surface. Then replace the standing valve 48 in the same fashion with the rods 22 and the on-off tool. After repairing or replacing the rod insert pump 24, simply run the rods 22 and rod insert pump 24 back into the hole through the power tubing string 12 and seat the rod insert pump 24 in the landing nipple 18 of the bottom hole assembly.

This time the power tubing string 12 will not have to be pumped clear with diluent or water solution before seating the rod insert pump 24 because when the rod insert pump 24 was unseated, the power tubing string 12 was full and all that fluid equalized out into the well bore clearing the power tubing string 12 at that time. Hook the rod string 22 onto the pumping unit 23 and start.

Figure 4A:
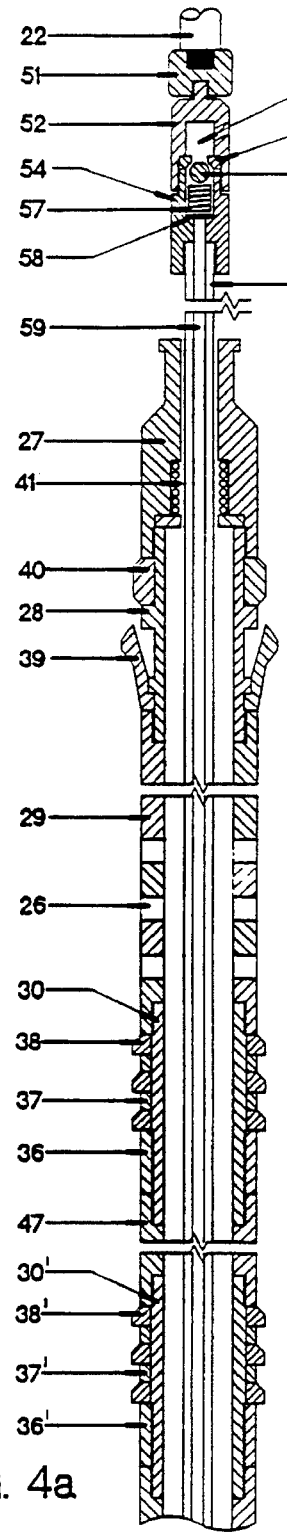
FIG. 4*a* is an enlarged sectional view of the upper portion of the pump of FIG. 4 as indicated by the arrow in FIG. 4.
Figure 4:
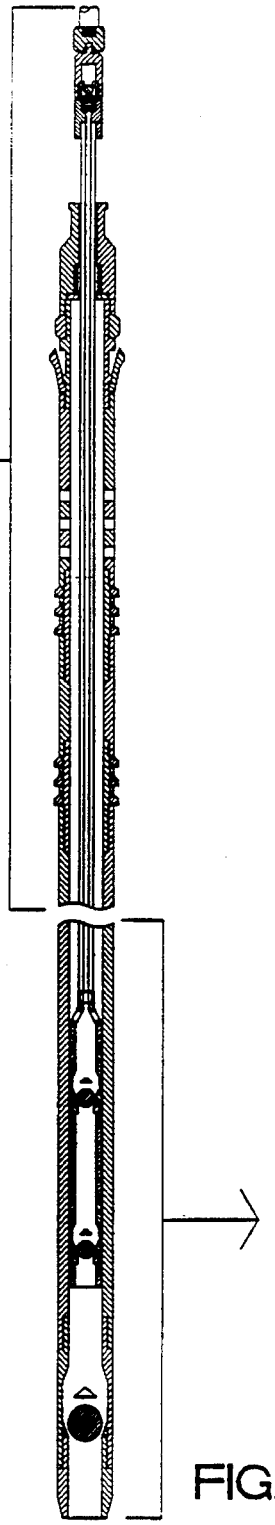
FIG. 4 is a diagrammatic vertical sectional view of an alternative rod insert pump disconnectably connectable inside the bottom hole assembly and includes optional hollow pull tube.
Figure 4B:
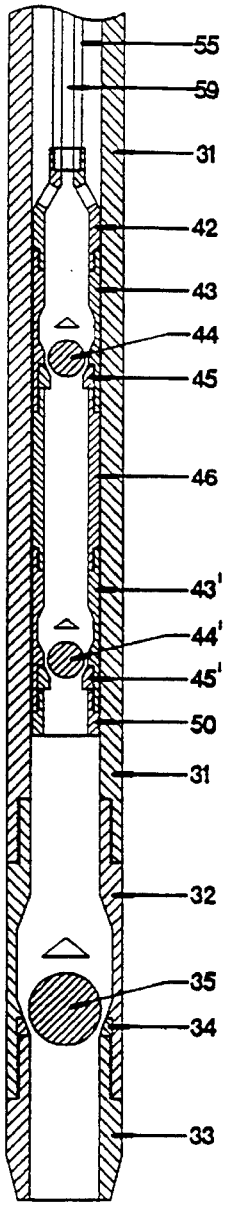
FIG. 4*b* is an enlarged sectional view of the lower portion of the pump of FIG. 4 as indicated by the arrow of FIG. 4.

FIGS. 4, 4(*a*) and 4(*b*) show a more detailed view of an alternative bottom hole rod insert pump 24 similar to that described and shown in FIGS. 3, 3*a* and 3*b*. Similar ports are given the same numbers in all the Figures. Except, the alternative rod insert pump 24 has a hollow pull tube 55 to replace the polished pull rod 25. The hollow pull tube 55 is for conducting diluent or water solution from the power tubing string 12 to inside the rod insert pump 24 to lubricate well fluids while traveling up the production tubing string 13, if the operator so desires. A check valve housing 52 and 54, which contains a check valve ball 53, check valve seat 56, check valve spring 57 and a flow control orifice 58, is attached to the lower end of the rod guide bushing 51 and a polished hollow pull tube 55 is attached to the lower end. A plunger cage 42 is attached to the lower end of the hollow pull tube 55. The hollow pull tube 55 has a bore 59. The check valve housing 52 and 54 has a port 60 affording communications of diluent or water solution between the power tubing string 12 and the bore 59. The remainder of the rod insert pump 24 is shown, described and operates in the same manner as the insert pump 24 in FIGS. 3, 3*a* and 3*b*. Install item of the rod insert pump 24 with the hollow pull tube 55 is the same as installation described with respect to the embodiment of FIGS. 3, 3*a* and 3*b* for installing the rod insert pump 24 with the polished pull rod 25. The down hole rod insert pump 24 with hollow pull tube 55 operates in the same fashion and manner as does the rod insert pump 24 with polished pull rod 55.

The following will describe the operation of the hollow pull tube 55 of the rod insert pump 24. The pumping unit 23 alternately raises and lowers the sucker rods 22, hollow pull tube 55 and the plunger through upstrokes and downstrokes in the conventional fashion. On each down stroke of the plunger, the retrievable standing valve 48 in the production flow path above the plunger closes decreasing the pressure in the area of under the standing valve 48 and above the plunger. This allows the hydrostatic pressure of the diluent in the power tubing string 12 to overcome the pressure that was in the hollow pull tube bore 59, compressing the check valve spring 57 forcing the check valve ball 53 downward away from the check valve seat 56 allowing a predetermined volume of diluent to pass through the flow control orifice 58 into the pump barrel 31. On the upstroke of the plunger, both traveling valves 44, 44' in the plunger close, creating a pressure great enough under the check valve ball 53 with help from the check valve spring 57 to force the check valve ball 53 against the check valve seat 56. This stops the entry of diluent into the pump barrel 31 through the hollow pull tube bore 59. The rest of the rod insert pump 24 operates in the same fashion as described with respect to FIGS. 3, 3*a* and 3*b*. The rod insert pump 24 with hollow pull tube 55 is retrieved in the same manner as described with respect to FIGS. 3, 3*a* and 3*b*.

The principles, preferred embodiments and modes of operation of the present invention have been described in the foregoing specification. However, the invention which is intended to be protected is not to be construed as limited to the particular embodiments disclosed. The embodiments are to be construed as illustrative rather than restrictive. Variations and changes may be made by others without departing from the spirit of the present invention. Accordingly, all such variations and changes which fall within the spirit and scope of the present invention is defined in the following claims are expressly intended to be embraced thereby.

What is claimed is:

1. Apparatus for producing well fluids from an oil bearing formation penetrated by a well comprising:

production tubing means forming a production flow path for production fluids between the earth's surface and a location in the well suitable for receiving well production fluids;

flow control means connected to the lower end of said production tubing means permitting flow of production fluids up said production flow path and preventing flow of production fluids down said production flow path;

power tubing means extending down said well in parallel relationship with said production tubing means to a location in said well suitable for receiving production fluids into the lower portion of said power tubing means from said well;

an insert type pump adapted to be inserted and removed from said power tubing means while said power tubing means are located in said well;

means for disconnectably connecting said insert type pump in said power tubing means adjacent the lower portion thereof in a position for pumping well fluids from the well into the lower portion of said power tubing means;

a cross-over flow means between the lower portion of said power tubing means and the flow path of said production tubing means below said flow control means for flowing production fluids out of said power tubing means and into said flow path of said production tubing means for transfer to the earth's surface; and means for operating said insert type pump.

2. The apparatus of claim 1 further characterized in that said means for operating said pump includes a pumping rod string operably connected to said insert type pump.

3. The apparatus of claim 1 further characterized by a parallel anchor having spaced apart parallel passages formed therein as the only passages through said parallel anchor, said production tubing means passing through one of said passages and said power tubing means passing through the other of said passages.

4. The apparatus of claim 1 further characterized in that the operative elements of said insert type pump are located in the well below the location of said flow control means.

5. The apparatus of claim 1 further characterized in that said flow control means includes a standing valve and wherein the standing valve is insertable and removable from said production tubing means while said production tubing means is positioned in said well.

6. Apparatus for pumping petroleum from a well penetrating a petroleum producing formation comprising a downhole assembly located in a well at a position adapted to receive petroleum from said well; said downhole assembly comprising a parallel anchor having a first passage and a second passage formed parallel to the central axis of the parallel anchor, a connecting pup tubing connected to said first passage of said parallel anchor and extending down said well, a standing valve means for permitting flow up said connecting pup tubing and preventing flow down said connecting pup tubing operably connected to said connecting pup tubing, a tubular gas anchor in said well below said second passage of the parallel anchor; a cross-over flow head connected between the lower end of said connecting pup tubing below the standing valve means connected thereto and an opening in said tubular gas anchor to provide a flow path for petroleum fluid from said gas anchor through said standing valve into the lower portion of said connecting pup tubing, a tubular landing nipple connected to a top section of said cross-over flow head and extending upward therefrom toward the second passage in said parallel anchor;

a production tubing string extending from the earth's surface down said well and inserted into the first passage of said parallel anchor to form a flow path to the earth's surface for petroleum;

a power tubing string in said well parallel to said production tubing string and extending through the second passage in said parallel anchor, connecting means connecting the lower end of said power tubing string to the upper end of said tubular landing nipple;

an insert type pump insertable into and removable from said power tubing and said tubular landing nipple;

means disconnectably connecting said insert type pump in operating position in said landing nipple for pumping well fluids up to said flow path for petroleum fluid to said production tubing string; and means for operating said insert type pump.

7. Apparatus for producing well fluids from an oil bearing formation penetrated by a well comprising:

production tubing means forming a production flow path for production fluids between the earth's surface and a location in the well suitable for receiving well production fluids;

flow control means in said apparatus permitting flow of production fluids up said production flow path and preventing flow of production fluids down said production flow path;

power tubing means extending down said well in parallel relationship with said production tubing means to a location in said well suitable for receiving production fluids into the lower portion of said power tubing means from said well;

an insert type pump adapted to be inserted and removed from said power tubing means while said power tubing means are located in said well;

means for disconnectably connecting said insert type pump in said power tubing means adjacent the lower portion thereof in a position for pumping well fluids from the well into the lower portion of said power tubing means;

a cross-over flow means between the lower portion of said power tubing means and the flow path of said production tubing means below said flow control means for flowing production fluids out of said power tubing means and into said flow path of said production tubing means for transfer to the earth's surface; and means for operating said insert type pump.

8. Apparatus for producing well fluids from an oil bearing formation penetrated by a well comprising:

production tubing means forming a production flow path for production fluids between the earth's surface and a location in the well suitable for receiving well production fluids;

flow control means in said apparatus permitting flow of production fluids up said production flow path and preventing flow of production fluids down said production flow path;

power tubing means extending down said well in parallel relationship with said production tubing means to a location in said well suitable for receiving production fluids into the lower portion of said power tubing means from said well;

a pump adapted to be inserted and removed from said power tubing means while said power tubing means are located in said well;

means for disconnectably connecting said pump in said power tubing means adjacent the lower portion thereof in a position for pumping well fluids from the well into the lower portion of said power tubing means;

a cross-over flow means between the lower portion of said power tubing means and the flow path of said production tubing means for flowing production fluids out of said power tubing means and into said flow path of said production tubing means for transfer to the earth's surface; and means for operating said pump.

* * * * *